US006321812B1

(12) United States Patent
Kral

(10) Patent No.: US 6,321,812 B1
(45) Date of Patent: Nov. 27, 2001

(54) PERIMETER DRIVEN LABELLER

(76) Inventor: Joseph Michael Kral, 30 Ramsay Road, Five Dock NSW 2046 (AU)

( * ) Notice: Subject to any disclaimer, the term of this patent is extended or adjusted under 35 U.S.C. 154(b) by 0 days.

(21) Appl. No.: 09/284,766

(22) PCT Filed: Sep. 10, 1997

(86) PCT No.: PCT/AU97/00590

§ 371 Date: May 19, 1999

§ 102(e) Date: May 19, 1999

(87) PCT Pub. No.: WO98/17537

PCT Pub. Date: Apr. 30, 1998

(30) Foreign Application Priority Data

Oct. 24, 1996 (AU) ..... 70369/96

(51) Int. Cl.[7] ..... B65C 9/00; B65C 9/04

(52) U.S. Cl. ..... 156/446; 156/475; 156/542; 156/566; 156/567; 198/377.01

(58) Field of Search ..... 156/475, 476, 156/542, 556, 566, 567, 568, DIG. 26, 446, 558; 198/377.01, 377.02, 377.07, 378

(56) References Cited

U.S. PATENT DOCUMENTS

| | | | | |
|---|---|---|---|---|
| 3,990,316 | | 11/1976 | Risi | 74/24 |
| 4,447,280 | * | 5/1984 | Malthouse | 156/85 |
| 4,566,933 | * | 1/1986 | Crankshaw et al. | 156/444 |
| 4,911,285 | | 3/1990 | Rogall | 198/474 |
| 5,078,826 | | 1/1992 | Rogall | 156/451 |
| 5,087,317 | | 2/1992 | Rogall | 156/456 |
| 5,185,053 | | 2/1993 | Tomashauser | 156/487 |
| 5,362,355 | | 11/1994 | Twele | 156/542 |
| 5,579,890 | * | 12/1996 | Harris | 198/377 |
| 5,785,803 | * | 7/1998 | Schiessl | 156/538 |
| 5,798,020 | * | 8/1998 | Coughlin et al. | 156/542 |

FOREIGN PATENT DOCUMENTS

| | | |
|---|---|---|
| 3025178 | 1/1982 | (DE) . |
| 2008708 | 1/1970 | (FR) . |

* cited by examiner

*Primary Examiner*—Richard Crispino
*Assistant Examiner*—Sue A. Purvis
(74) *Attorney, Agent, or Firm*—Ladas & Parry

(57) ABSTRACT

An applicator to apply a label (11) to an object such as a container (12). Each label (11) is applied by a label applicator (68). More particularly, the apparatus (10) is adapted to apply labels (11) irrespective of whether the container (12) is of circular or non-circular configuration. The container (12) is mounted on a holding plate (23) which is caused to rotate so that the peripheral speed of the container (12) is substantially constant.

11 Claims, 8 Drawing Sheets

PERIMETER DRIVEN LABELLER

TECHNICAL FIELD

The present invention relates to labelling machines.

BACKGROUND OF THE INVENTION

Previous automatic labelling machines consist of an automatic label dispenser and an automatic system where the object to be labelled is presented to the close proximity of the exposed, adhesive part of the label which is then pressed onto the surface of the object by a roller, brush, stamper, air blast, conveyor belt, or some other means. The label dispenser dispenses the label at the same speed as the surface speed of the face of the object to be labelled. The object may travel through without changing its position in relation to the direction of travel of the input-output conveyor, it may stop and spin at the label dispensing point, in case of a round or cylindrical object. Square or rectangular objects, where the label is to be applied to more than one face of the object, require two or more label dispensers. At present, a continuous, wrap-around label can not be applied unless the object is nearly round in cross-section.

OBJECT OF THE INVENTION

It is the object of the present invention to overcome or substantially ameliorate the above disadvantages.

SUMMARY OF THE INVENTION

There is disclosed herein an applicator to apply a label to an article having a bottom and side peripheral wall, said container being of a circular or non-circular configuration, said apparatus comprising:

a holding means which receives and holds the container;

a label applicator to apply a label to the peripheral surface of the container;

drive means to cause movement of the container about an axis generally parallel to the peripheral surface so that said peripheral surface passes the applicator at a substantially constant speed, said drive means including a cam slot in said holding means, which slot has a configuration corresponding to the configuration of the peripheral surface, a pair of rollers located in said slot to maintain said peripheral surface adjacent said applicator, and a drive member operatively associated with the holding means to cause movement thereof about an axis generally parallel to the peripheral surface.

BRIEF DESCRIPTION OF THE DRAWINGS

A preferred forms of the present invention will now be described by way of example with reference to the accompanying drawings wherein.

DETAILED DESCRIPTION OF THE PREFERRED EMBODIMENT

Figure 1:
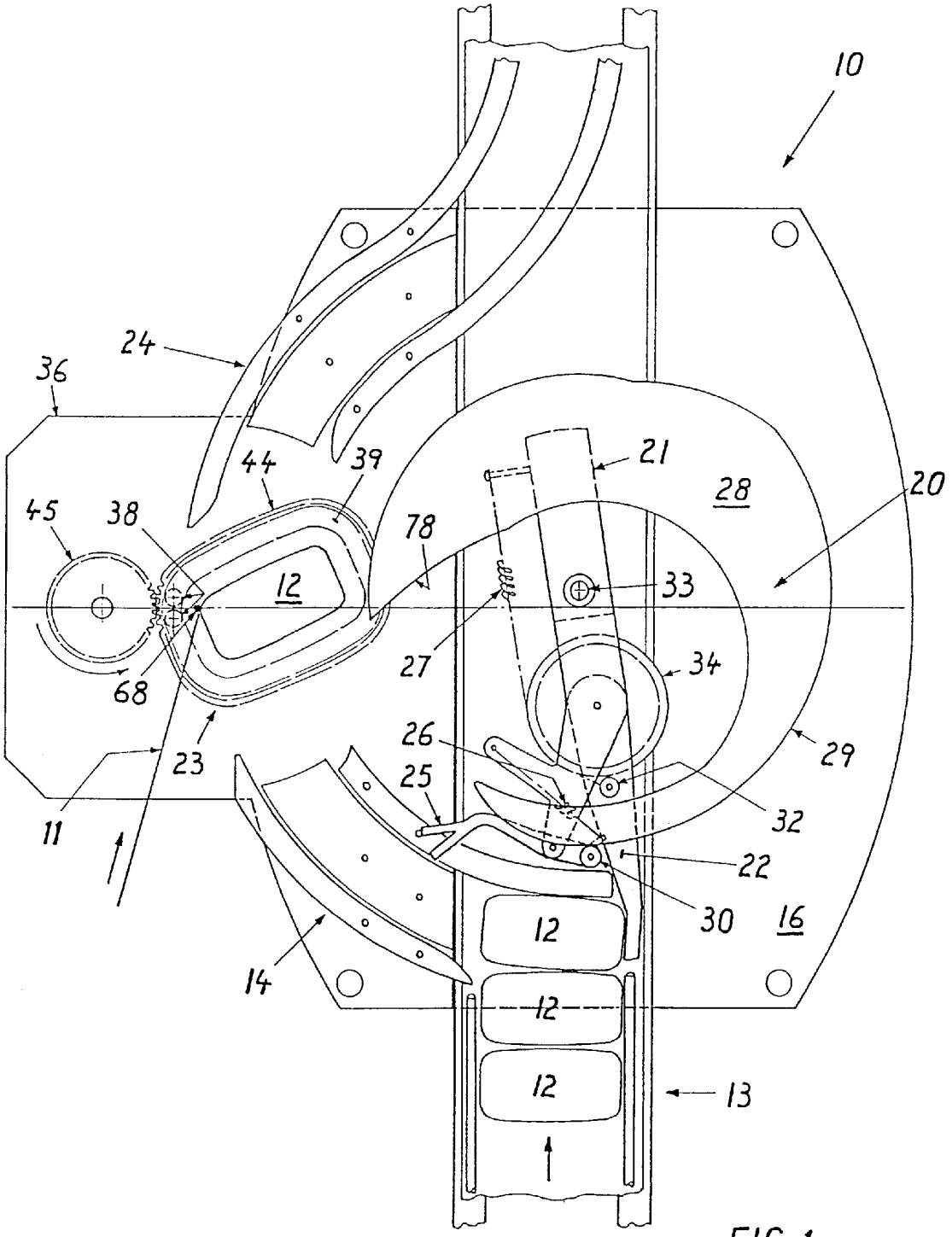
FIGS. 1 to 4 are schematic top plan views of a labelling apparatus in various stages of operation.
Figure 2:
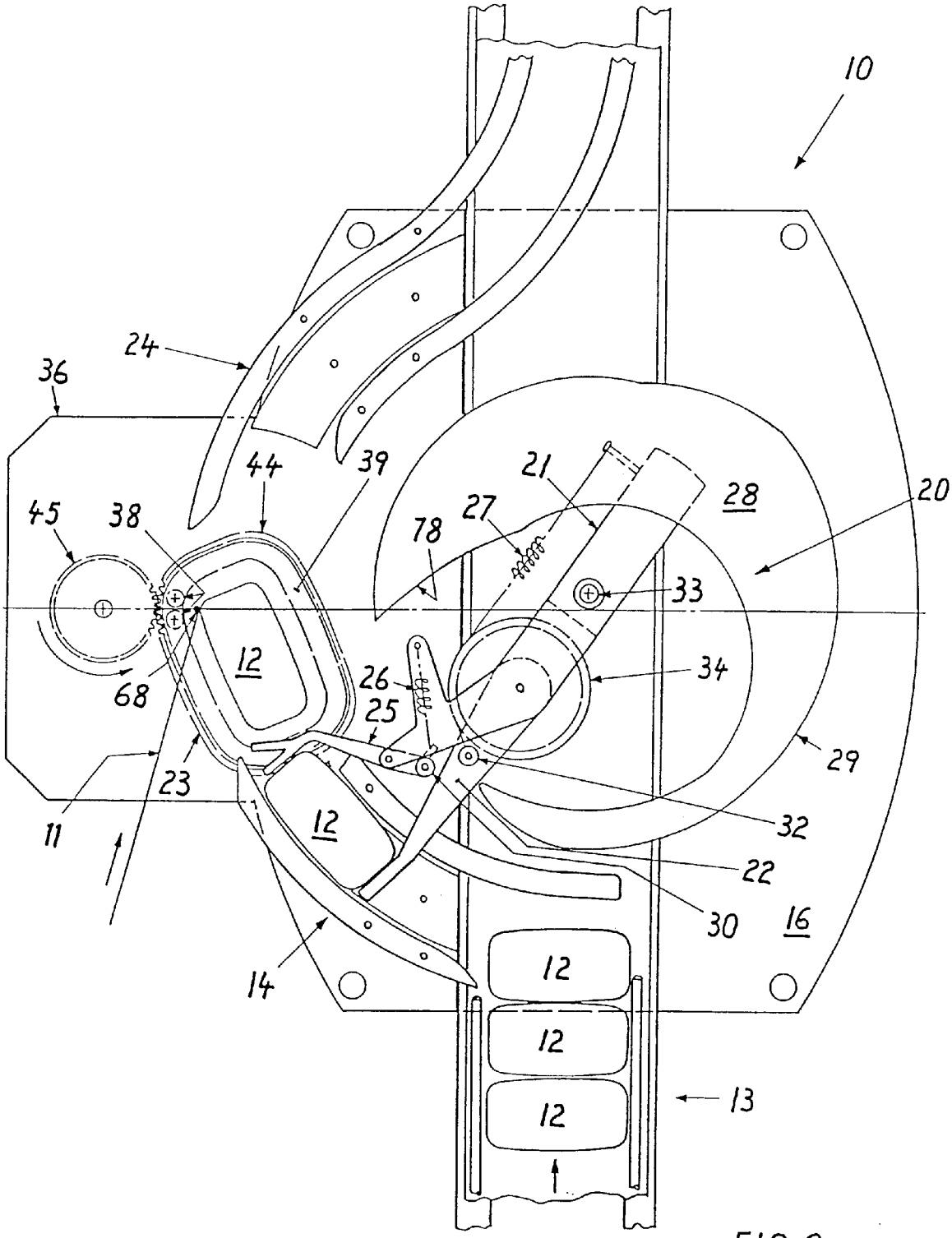
Figure 3:
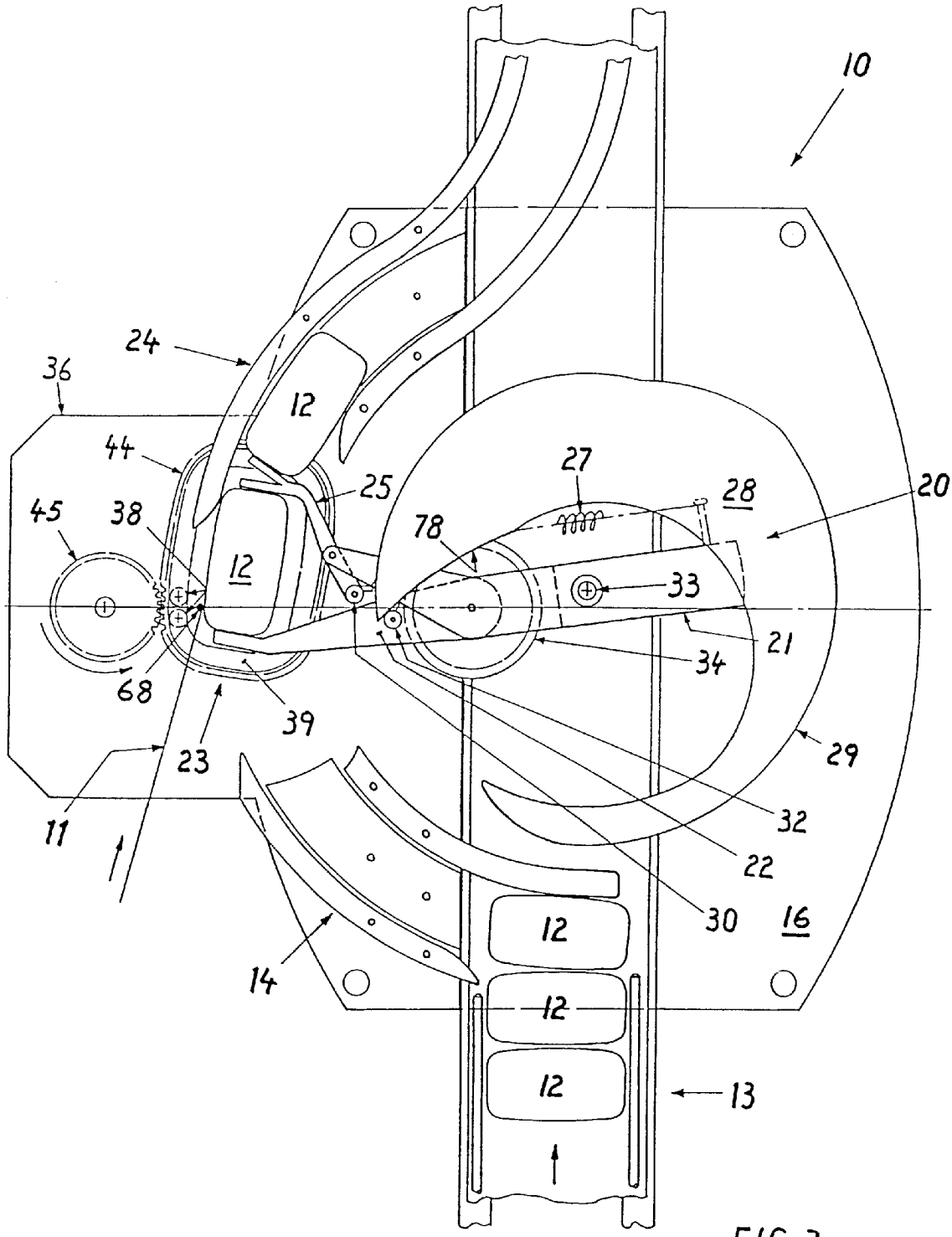

In FIGS. 1 to 9 of the accompanying drawings there is schematically depicted an apparatus 10 to apply a label 11 to an object such as a container 12. Each label 11 is applied by the label applicator roller 68.

The container 12 has a top, bottom and side peripheral wall. The container 12 may be of circular or non-circular configuration.

The apparatus 10 includes a delivery chute 13, which may include a conveyor and guide rails, which receives a stream of containers 12 which are to be labelled. The end container 12 is located at a predetermined position relative to a guide 14 so as to be aligned therewith. The base frame 15 which includes a series of plates 16, 17, 18 and 36 joined by a series of connecting bolts 19 which maintain the plates 16, 17, 18 and 36 in a generally parallel spaced fixed relationship. This relationship can be adjusted when required. The chute 13 and guide 14 are mounted on the plate 16.

Depending from the plate 17 so as to be rotatably supported thereby is a delivery assembly 20. The assembly 20 includes three arms, the main arm 21, the pusher arm 22 and the holding arm 25. With the arm 22 being rotatably driven, it moves the end container 12 along the guide 14 to be delivered to a holding plate 23. At the holding plate 23, the container 12 has the label 11 applied. The clamping arm 25 which is pivotally mounted at the extremity of the main arm 21 then moves the labelled container 12 to a further chute 24 wherefrom the labelled container 12 is removed from the apparatus 10. As can be seen, the clamping arm 25 has two functions, it cooperates with the arm 22 to securely hold the end container 12 as it is moved to the plate 23 and it propels the previously labelled container 12 to and along the chute 24 as can be best seen in FIGS. 3 and 4.

The arm 25 has extending from it a spring 26 which extends to the arm 21 and biases the arm 25 into a grasping position with respect to the engaged container 12. Extending between the arms 21 and 22 is a spring 27 which urges the arms 22 to a predetermined working position as best seen in FIG. 1. This position would be defined by stop surfaces which would abut under the influence of the spring 27.

Movement of the arm 25 is coordinated with rotational movement of the arms 21 and 22 by means of a cam 28 which has an outer cam surface 29 engaged by the cam follower 30 mounted on the arm 25. The cam surface 29 is configured to move the arm 25 into and out of engagement with the container 12 at the appropriate position as each container 12 is moved through the apparatus 10. For example, the surface 29 has an extremity which would release the cam follower 30 and therefore permit pivoting movement of the arm 25 under the influence of the spring 26 to engage the container 12 as it is moving along the guides 14.

Figure 4:
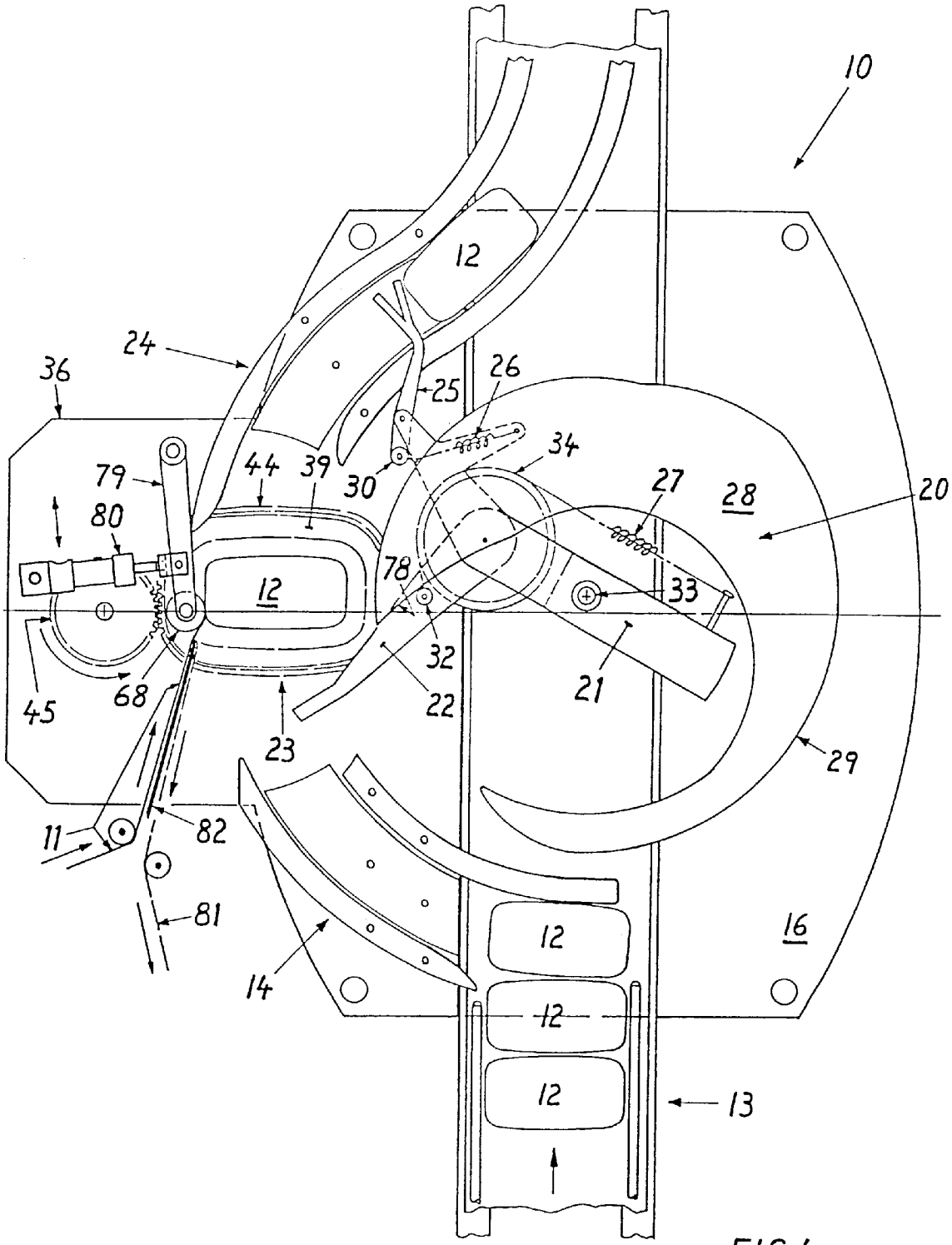
Figure 5:
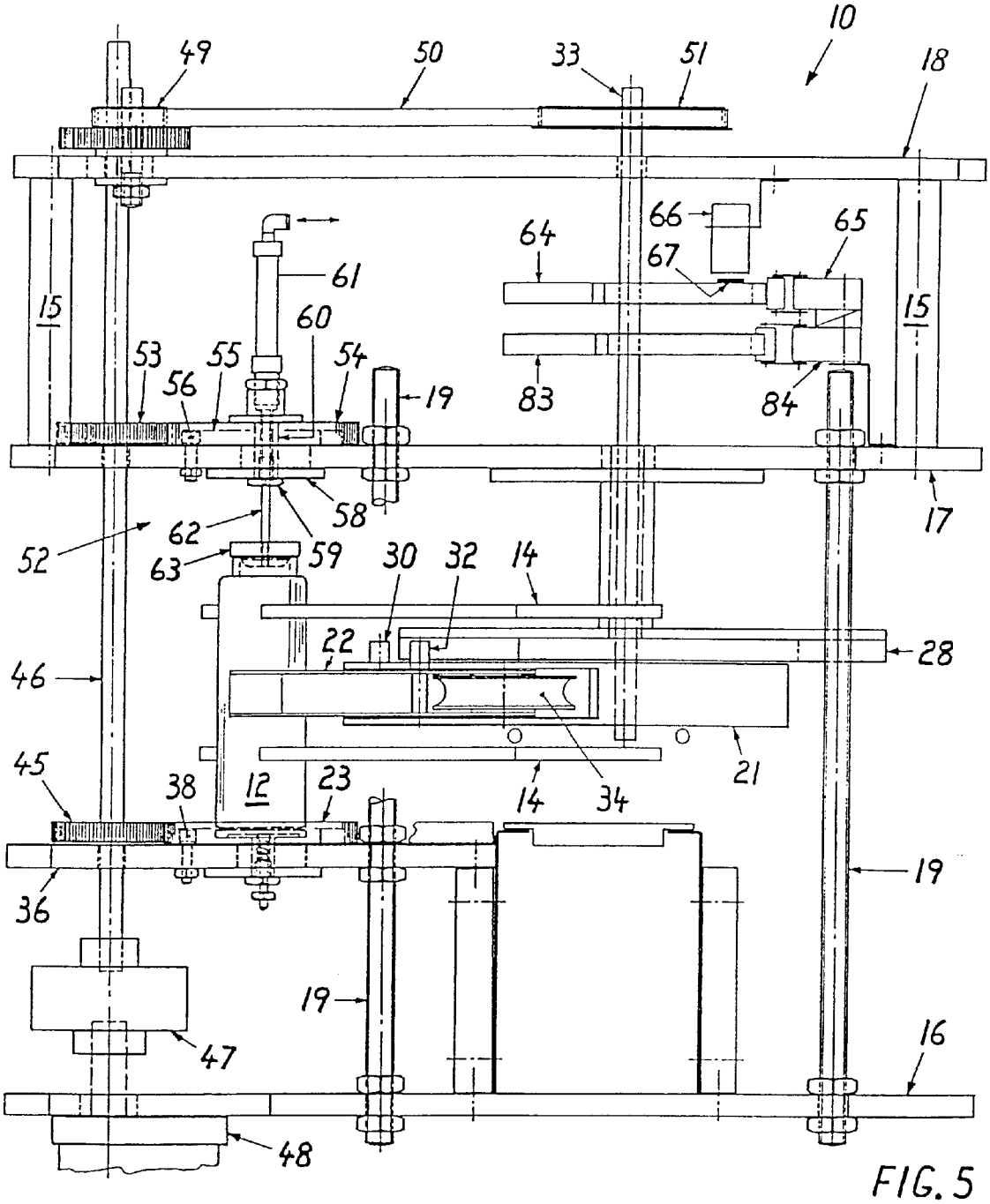
FIG. 5 is a schematic side elevation of the apparatus of FIGS. 1 to 4.
Figure 6:
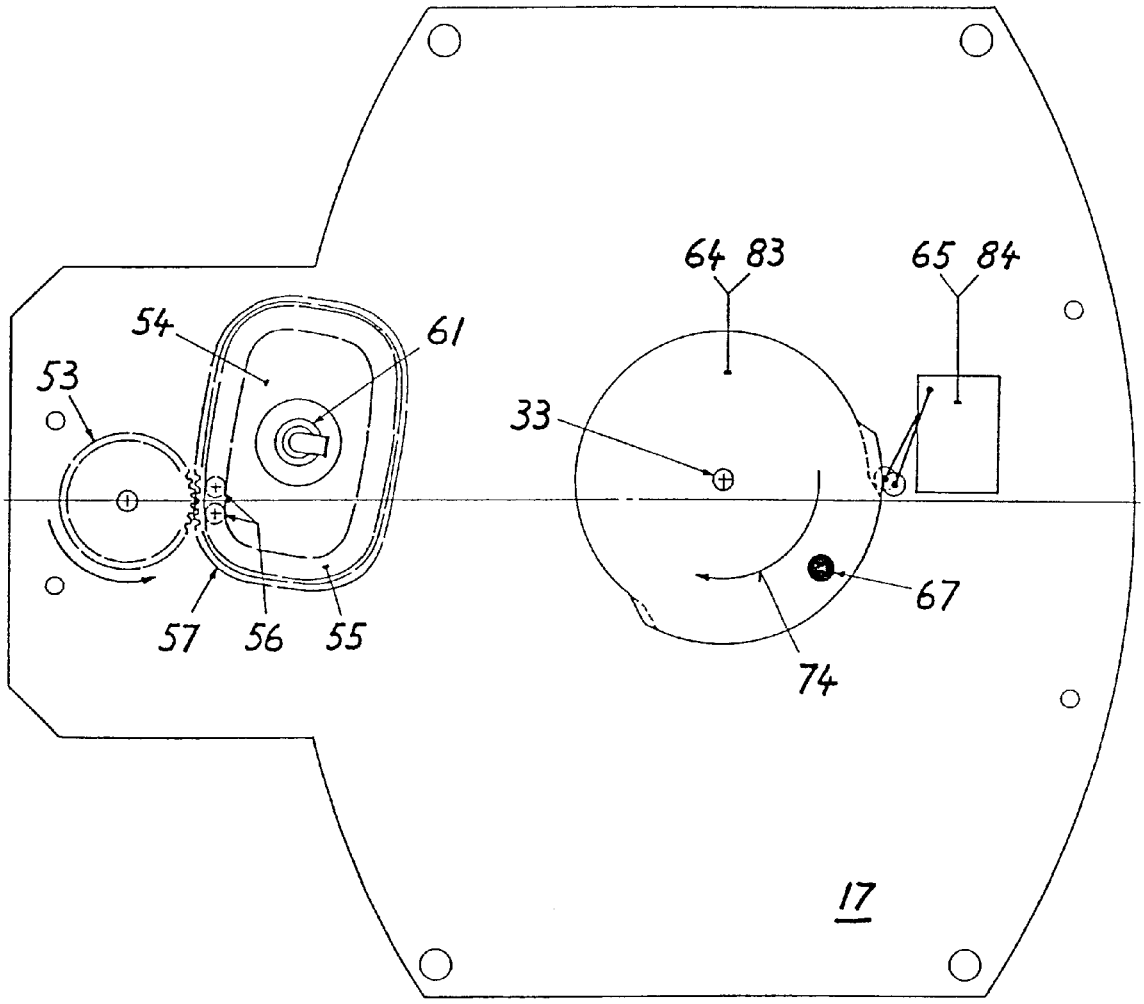
FIG. 6 is a schematic plan view of a portion of the apparatus of FIGS. 1 to 4.
Figure 7:
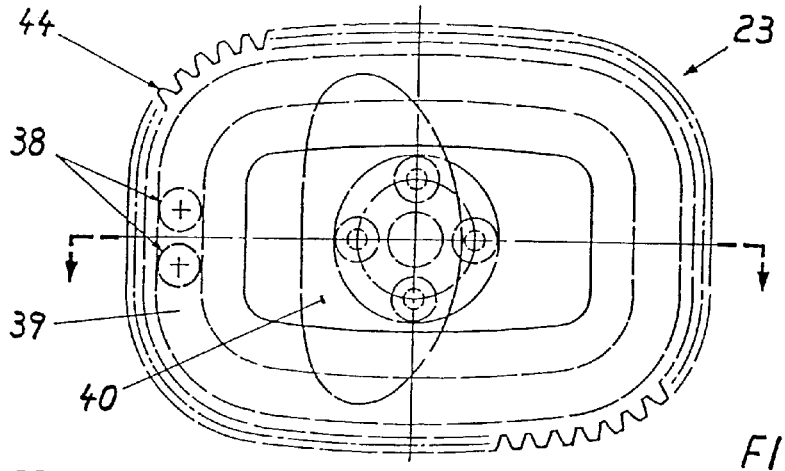
FIG. 7 is a schematic plan view of a plate which receives an object to which a label is to be applied.
Figure 8:
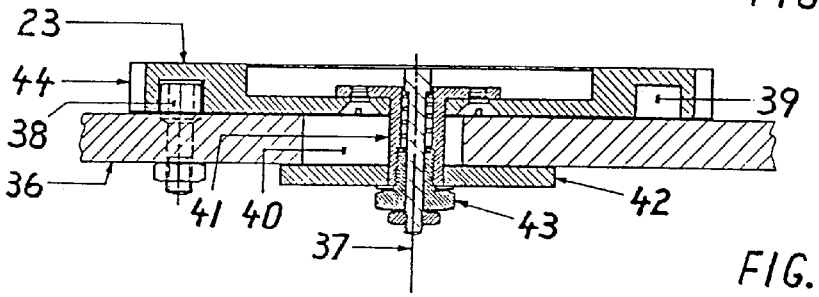
FIG. 8 is a schematic sectioned side elevation of the plate of FIG. 7.
Figure 9:
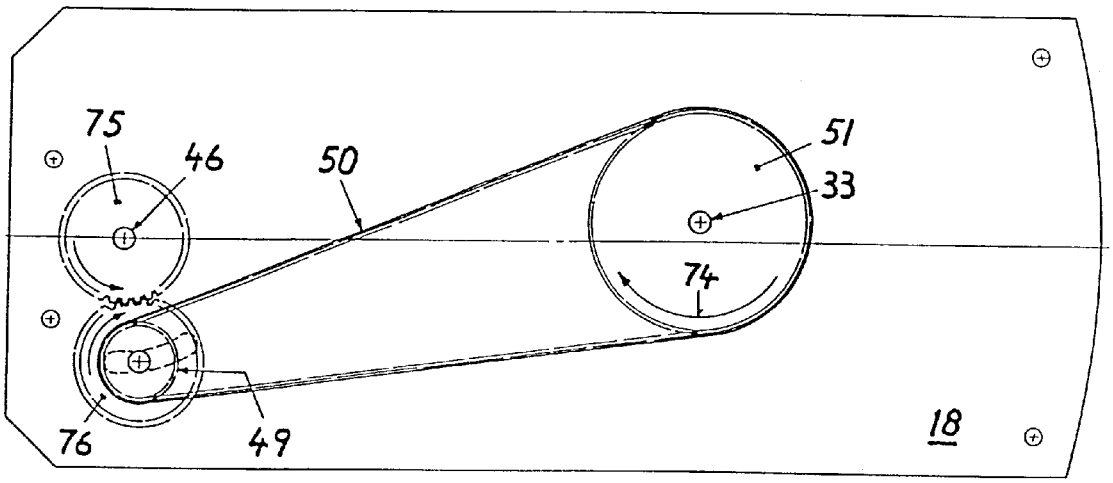
FIG. 9 is a schematic plan view of a drive mechanism employed in the apparatus of FIGS. 1 to 4.

The arm 21 is fixed to a rotatably driven shaft 33 and pivotally supports the arm 22. Affixed to the arm 22 is a cam roller 32 which, when in contact with the cam surface 78, causes the arm 22 to move away from the arm 25, therefore releasing the container 12 and, at the same time, moving out of the way of the container as can be seen in FIG. 4. There is also provided a roller 34 about which portion of the spring 27 passes.

The holding plate 23 is mounted on a further plate 36 of the frame 15. More particularly the plate 23 is mounted on the plate 36 for movement about a vertical axis 37 which is caused to move about a closed loop by interaction between the plate 23 and a pair of rollers 38 located within a cam slot 39 formed in the plate 23. A hollow shaft 40 is attached to the plate 23 and extends through an enlarged aperture 41 in the plate 36. A retaining washer 42 slidably abuts the underside of the plate 36 and retains the plate 23 mounted on the plate 36 by threaded engagement of a nut 43 on the lower extremity of the shaft 40. The axis 37 is generally parallel to the peripheral surface of the container 12 to which the label is to be applied.

The peripheral edge of the plate 23 is provided with gear teeth 44 which mesh with teeth of a gear 45 so as to be driven thereby.

The gear 45 is mounted on and driven by a shaft 46 which extends to a torque limiting device 47. The device 47 is driven by a motor (preferably electric) 48. The shaft 46 has its longitudinal axis laterally of but spaced between the rollers 38.

The upper end of he shaft 46 is provided with a gear 75 which drives gear 76, thereby changing the direction of rotation of gear 76 to which a timing pulley 49 is attached. The timing pulley 49 engages a timing belt 50 which drives a further pulley 51 fixed to the shaft 33 so as to drive the shaft 33.

The container 12 is clamped in position on the plate 23 by means of a clamp assembly 52. The clamp assembly 52 is also rotatably driven from the shaft 46 via gear 53. As the container 12 is caused to rotate about the axis 37 the clamp assembly 52 must also move in the same manner. The clamp assembly 52 includes a plate 54 having a slot 55 engaged with rollers 56. The plate 54 has external gear teeth 57 engaged with the gear 53. The plate 54 is of the same configuration as the plate 23 and therefore the rotational axis of the plate 54 is maintained coaxial with the rotational axis 37 of the plate 23. The plate 54 is maintained in position by a sliding retaining washer 58 held in position by engagement of a nut 59 on a threaded portion of the hollow shaft 60.

Mounted on the plate 54 is a pneumatic cylinder 61 having a piston rod 62 which passes through the hollow shaft 60. The lower extremity of the piston rod 62 has a clamp 63 which engages the upper end of the container 12 to press the container 12 into contact with the plate 23. The clamp 63 is shaped to fit snuggly into or at the upper extremity of the container 12.

A valve is operated to coordinate delivery of air under pressure to the pneumatic cylinder 61 to engage and release the container 12 at the appropriate time, by raising and lowering the clamp 63.

Operation of the pneumatic cylinder 61 is coordinated with the remainder of the apparatus 10 by means of a cam 64 fixed to the shaft 33. The cam 64 operates a pneumatic valve 65 which governs the delivery of air under pressure to the cylinder 61. A proximity switch 66 detects a projection 67 so that the switch 66 cooperates with the remainder of the apparatus 10. The switch 66 controls a label delivery mechanism to deliver the labels 11.

It should be appreciated that the motor 48 is continuously rotating in the direction of the arrow 74 and therefore continuously driving the shaft 33 through repeated revolution. Accordingly, there needs to be relative movement between the shaft 33 and the arm 22. This relative movement is required when the container 12 is clamped against the plate 23 and engaged by the arm 22. When the container 12 is released for movement the arm 22 can resume its motion. The arm 22 has a rest position defined by cooperating stop surfaces and is urged toward that rest position by means of the spring 27.

The container 12 at the position of the label applicator roller 68 is intended to have a constant peripheral speed. As discussed previously this is achieved by the meshing engagement of the gear 45 with the teeth 44. To maintain this meshing engagement the axis 37 is caused to move as discussed above. Accordingly the plate 23 and cam slot 39 must have a configuration corresponding to the configuration of the container 12. More particularly, the plate 23 and cam slot 39 must have a configuration which corresponds to the transverse cross-sectional configuration of the container 12 as seen in FIGS. 1 to 4.

The applicator roller 68 is supported on a pivotally mounted arm 79, urged to maintain the roller 68 on the peripheral surface of the container 12 by means of a pneumatic cylinder 80.

Labels are delivered to the roller 68 by means of a backing film 81 which passes a delivery blade 82 which causes the individual labels to "peel" from the backing film 81 and passed to the roller 68 which then applies the individual labels to the containers 12.

The pneumatic cylinder 80 is controlled by means of a cam 83 which cooperates with a valve 84 to govern the delivery of air under pressure to the cylinder 80 and thereby coordinate its operation with respect to the remainder of the apparatus 10. The valve 84 via the cylinder 80 causes movement of the roller 68 so as to enable the initial securing of the leading portion of each label to the container 12.

The arm 22 is also required to be free for movement relative to the shaft 33 to accommodate the non-circular configuration of the container 12. When the arm 22 is in contact with the container 12 and the container 12 is clamped in position on the plate 23, the arm 22 needs to be deflected from the peripheral surface of the container 12 which is being labelled.

To accommodate various shaped containers, a series of sets of plates 23 and 54 are provided. Each set having a shape corresponding to the shape of the container to be labelled.

Figure 10:
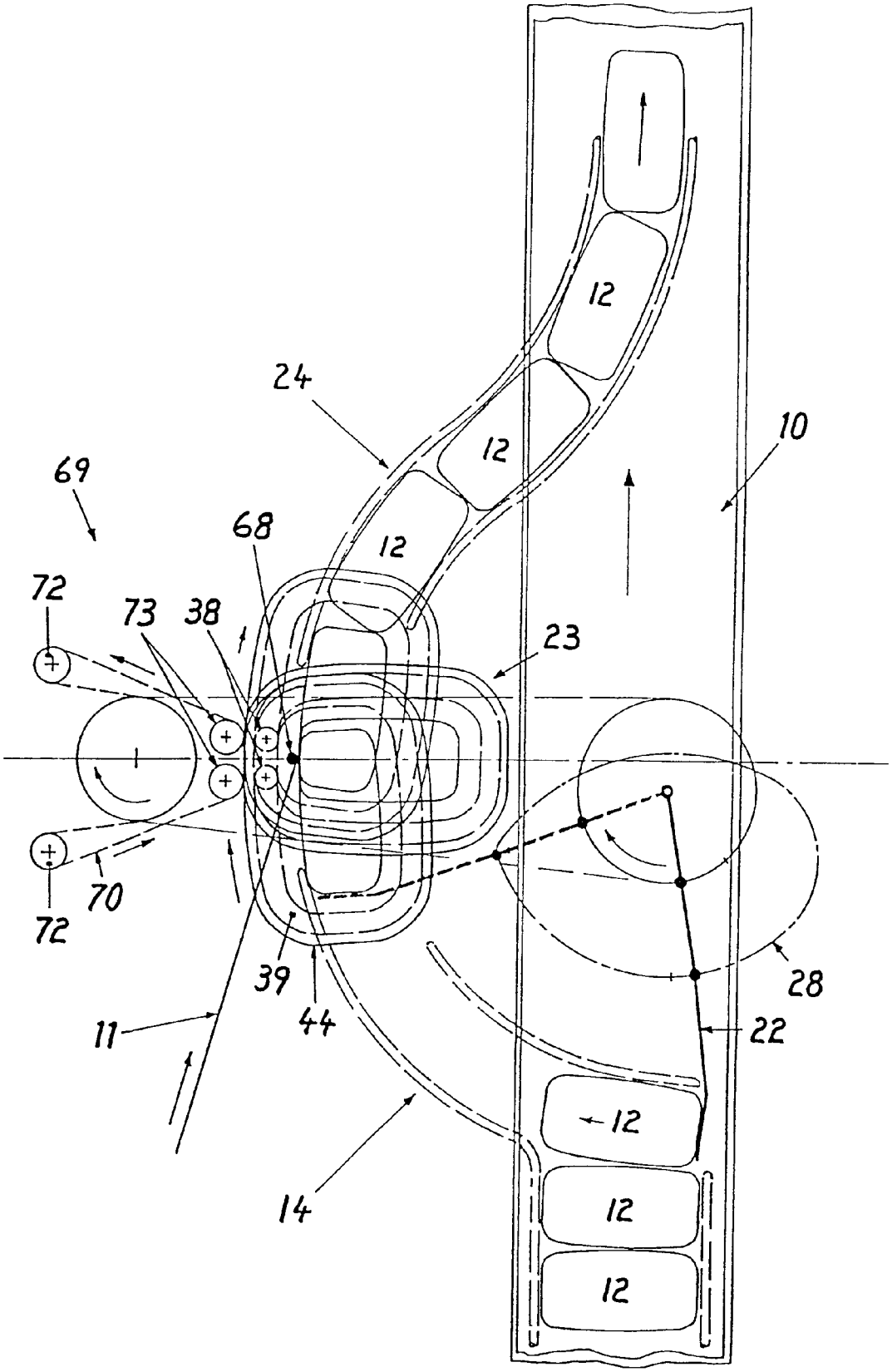
FIG. 10 is a schematic plan view of an alternative construction of the apparatus of FIGS. 1 to 4.

FIG. 10 is a schematic illustration of an alternative construction of the machine 10 of FIGS. 1 to 9. In this embodiment an alternative drive mechanism 69 is provided to drive the container 12 to have a constant peripheral speed at its point of contact with the roller 68. As in the previous embodiment the plate 23 is provided with gear teeth 44. The gear teeth 44 mesh and engage gear teeth on a belt 70 driven by means of a pulley 71 attached to the shaft 46. The belt 70 passes about idler rollers 72 as well as idler rollers 73 which maintain meshing engagement between the belt 70 and teeth 44.

In the above described preferred embodiments two different drive systems are described. For example in the embodiment of FIG. 1 is gear teeth 44 and gear 45 which cause rotation of the plate 23. In the embodiment of FIG. 10, the belt 70 and the teeth 44 perform the same function. However, other drive means may be employed such as chain drive systems and friction drive systems.

In the above two described embodiments, the container 12 is held on the plate 23 by means of the clamp assembly 52. As an alternative construction, the clamp assembly 52 could be replaced by a vacuum system or other clamping arrangement purely associated with the plate 23. This would then eliminate the clamp assembly 52 and the drive system associated therewith.

What is claimed is:

1. An applicator assembly to apply a label to a container having top, bottom and side walls with a peripheral surface, said container being of a circular or non-circular configuration, said assembly comprising:

a holding means which receives and holds the container;

a label applicator to apply a label to the peripheral surface of the container;

drive means to cause movement of the container about an axis generally parallel to the peripheral surface so that said peripheral surface passes the applicator at a substantially constant speed, said drive means including a cam slot in said holding means, which slot has a configuration corresponding to the configuration of the peripheral surface, a pair of rollers located in said cam slot so that engagement therein maintains said peripheral surface adjacent said applicator, and a driven member operatively associated with said holding means to cause movement thereof about said axis generally parallel to the peripheral surface thereby enabling the label applicator to apply the label to the peripheral surface of circular and non-circular containers.

2. The assembly of claim 1, wherein said holding means comprises an engagement portion with a configuration corresponding to the configuration of said peripheral surface; and said drive means includes a drive member having a circular configuration and driving said driven member, with said driven member having a rotational axis laterally spaced from but between said rollers.

3. The assembly of claim 2, wherein said engagement portion has a drive surface with gear teeth, and said driven member is a circular gear meshed with said gear teeth.

4. The assembly of claim 2, wherein said drive member is circular, and said assembly further includes a drive belt driven by said drive member.

5. The assembly of claim 1, wherein said holding means is supported so that said axis is moved along a predetermined path.

6. The assembly of claim 5, wherein said holding means comprises a container receiving member upon which the container is placed, and clamp means to secure the container in position on the receiving member so that said peripheral surface passes said label applicator.

7. The assembly of claim 6, wherein said receiving member and clamp means move about said axis and are moved in a coordinated manner.

8. The assembly of claim 7, wherein said clamp means has a drive surface with gear teeth providing an engagement portion, and a drive member drivingly associated with the clamp means engagement portion to cause movement thereof, the clamp means engagement portion having a configuration corresponding to the configuration of the peripheral surface of the container.

9. The assembly of claim 8, wherein said clamp means is provided with a clamp means cam slot, with said clamp means cam slot being engaged by a pair of rollers which cause the clamp means to move in a coordinated manner with respect to the holding means.

10. The assembly of claim 1, further including:

delivery means to deliver the container to said holding means, said delivery means including a delivery device to receive a plurality of containers and locate one of the containers at a predetermined position, and an arm assembly rotatably driven about a fixed axis and configured to engage said one container and move said one container to said holding means, said arm assembly including:

a first arm to engage said one container and move it form said holding means, and a second arm to engage the container to aid in retaining the container in engagement with the first arm.

11. The assembly of claim 10, wherein said second arm also aids in propelling a labeled container from the apparatus.

* * * * *